US010471579B2

(12) United States Patent
Zhang

(10) Patent No.: US 10,471,579 B2
(45) Date of Patent: Nov. 12, 2019

(54) NAILING MACHINE

(71) Applicant: Huading Zhang, Taizhou (CN)

(72) Inventor: Huading Zhang, Taizhou (CN)

( * ) Notice: Subject to any disclaimer, the term of this patent is extended or adjusted under 35 U.S.C. 154(b) by 203 days.

(21) Appl. No.: 15/738,142

(22) PCT Filed: Mar. 25, 2016

(86) PCT No.: PCT/CN2016/077291

§ 371 (c)(1),
(2) Date: Dec. 20, 2017

(87) PCT Pub. No.: WO2016/206423

PCT Pub. Date: Dec. 29, 2016

(65) Prior Publication Data

US 2018/0222028 A1 Aug. 9, 2018

(30) Foreign Application Priority Data

Jun. 26, 2015 (CN) ..... 2015 2 0454838 U

(51) Int. Cl.
*B25C 1/06* (2006.01)
*B25C 1/04* (2006.01)

(52) U.S. Cl.
CPC ..... *B25C 1/047* (2013.01); *B25C 1/06* (2013.01)

(58) Field of Classification Search
CPC ..... B25C 1/047; B25C 1/06
USPC ..... 227/8, 10
See application file for complete search history.

(56) References Cited

U.S. PATENT DOCUMENTS

| | | | |
|---|---|---|---|
| 7,410,085 | B2 | 8/2008 | Wolf et al. |
| 2010/0213235 | A1 | 8/2010 | Pedicini et al. |
| 2014/0054350 | A1 | 2/2014 | Pedicini |
| 2015/0129630 | A1 | 5/2015 | Matsuno |

FOREIGN PATENT DOCUMENTS

| | | | |
|---|---|---|---|
| CN | 103846868 | A | 6/2014 |
| CN | 204019481 | U | 12/2014 |
| CN | 204736190 | U | 11/2015 |
| WO | WO2012061295 | A2 | 5/2012 |

OTHER PUBLICATIONS

International Search Report of PCT/CN2016/077291.

*Primary Examiner* — Michelle Lopez
(74) *Attorney, Agent, or Firm* — Minder Law Group; Willy H. Wong

(57) ABSTRACT

The nailing machine includes a closed first cylinder and a closed second cylinder, a working chamber of the first cylinder and a working chamber of the second cylinder are communicated with each other. A first piston inside a first cylinder is fixedly connected with a striker that has a locking part. The locking part could be locked by a pawl. The second cylinder is provided with a second piston reciprocated by a motor between a first position and a second position. When the second piston is in the first position, after the first piston moves inward, the pawl snaps at the locking part of the striker. When the second piston is in the second position, the motor drives the pawl to disengage from the locking part. the motor drives the second piston to compress air, and triggers the pawl, achieving the rapid and continuous firing of strip nails.

8 Claims, 7 Drawing Sheets

NAILING MACHINE

RELATED APPLICATIONS

This application is a national stage entry of International Application No. PCT/CN2016/077291 filed Mar. 25, 2016, and claims benefit of Chinese Patent Application No. 201520454838.8 filed Jun. 26, 2015.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention pertains to the technical field of machine manufacturing, and more particularly to a nailing device, specifically, a nailing machine.

Related Art

A nailing machine that is a nail gun, includes electric nail gun, pneumatic nail gun, gas nail gun, manual nail gun, and so on. A pneumatic nail gun is also known as pneumatic nailing machine. The existing pneumatic nailing machines mostly use the pneumatic pump, generating the air pressure to push the striker, as the power source. High pressure gas drives the striker in the cylinder of the nailing machine to execute the hammering motion, driving nails from the strip nails into the object, or shooting the nails out. Normally, the nail gun body assembly is composed of a gun body, a cylinder, a balancing valve, a trigger assembly, a striker assembly, a cushion, a gun muzzle, and a gun groove. It applies the pressure difference between compressed air and atmospheric, and, through the trigger action, reciprocate the striker within the cylinder. The nailing machine magazine assembly consists of the gun head, gun cover, fixed magazine, replaceable magazine, and other accessories. Through the action of the compression spring or tension spring, the nail will be sent into the gun cover groove. When the striker egresses the nozzle, a nail shoots out.

Chinese patent (publication number: CN204019481U; publication date: Dec. 17, 2014) discloses a pneumatic nailing device, consisting of nail feeding system, cover, cover screws, press block, press block screws, and striker. The upper end of the nail feeding system is provided with a nail passage. The striker is arranged in the nail passage. The cover and the press block is arranged above the nail passage. The striker can move within the nail passage. The cover is provided with a through hole. The upper end of the nail feeding system is provided with cover screw threaded holes. Through holes are provided with cover screws. The cover screws pass through the through holes, and are tighten within the cover screw threaded holes. The cover is provided with a magnet hole. A magnet is provided in the magnet hole.

The above patent does not disclose a specific nail feeding system structure, while the air compressor used in the prior art, generating the air pressure to push the striker, is adopted as the power source. Structure wise, it is more bulky, also the continuous efficiency of firing the striker cannot be guaranteed.

SUMMARY OF THE INVENTION

One objective of one embodiment of the present invention addresses the above problems of the prior art, a nailing machine is provided. The technical problem to be solved by one embodiment of the present invention is how to reduce the volume and weight of the nailing machine and ensure that the nailing machine can continuously and efficiently fire.

In order to solve the above technical problem. The technical solution of one embodiment of the present invention is as follows:

A nailing machine, characterized in that, the nailing machine includes a first cylinder and a second cylinder. The working chamber of the first cylinder and the working chamber of the second cylinder communicate with each other. The first cylinder has a first piston within and the first piston is fixedly connected with a striker. The striker has a locking part. The nailing machine also includes a pawl. A second piston is arranged in the second cylinder, and a second piston is reciprocated between a first position and a second position of the second cylinder by a motor. When the second piston is in the first position and the first piston moving inward with the striker, the striker is locked at the locking part of the striker by the pawl. When the second piston is in the second position, the motor drives the pawl to disengage from the locking part. It is characterized in that a housing is hinged with a swing bar, the swing bar links with the pawl to keep a synchronous motion, an actuator, synchronously driven by the motor to make a circular motion, can push the swing bar once to make the pawl disengage from the locking part during each revolution of the actuator.

The working principle is as follows. The nailing machine reciprocates the second piston in the second cylinder through the motor. The second piston can reach the two extreme points, at the first position and the second position. When the second piston reaches the first position, the second cylinder has a negative pressure generated within and, due to the mutual communication between the first cylinder and the second cylinder, sucks the first piston, and moves the first piston inward. Thereby, the striker also retracts inward to the first cylinder. After the first piston reaches the extreme point, the pawl and the locking part of the striker snap with each other, limiting the movement of the striker. Then, the motor drives the second piston for the next stroke. The second piston moves to the second position. High pressure is generated in the first cylinder and the second cylinder. Since the first piston and the striker are constrained by the mutual snap between the pawl and the locking part, the first piston and the striker remain stationary. After the second piston reaches the second position, the motor continues to work, triggers the pawl, and disengages the pawl from the locking part. Pushed by the high-pressure gas, the striker ejects rapidly and forcefully alone with the first piston. The nailing machine is also often used in conjunction with a nail storage magazine. Strip nails are placed inside the magazine, with the first nail in the strip nails opposite to the striker. By the impact of the striker, the nail is nailed into an object or the nail shoots out. This nailing machine needs no extra air pump, only a power supply, resulting a reduced space requirement.

In one embodiment of the technical scheme, the motor drives the second piston to compress air and also drives the pawl to achieve the rapid and continuous firing of strip nails.

In one embodiment of the nailing machine described above, the motor is a DC motor. A hinge axle is provided on a crank which is pivot connected with the rotating shaft of the motor and the hinge axle is capable of rotating circumferentially about the axis of the rotating shaft of the motor, one end of the hinge axle extends outward to form the actuator, the hinge axle is pivot connected with a rod connected with the second piston. One end of the rod is pivotally connected to the hinge axle. The other end is hinged on the second piston. As an alternative, one end of the rod is pivotally connected to the hinge axle. The other end is connected to the second piston through a universal joint or a ball joint. It is also conceivable to fix the actuator at other positions on the crank as long as no mechanical interference is formed according to the teachings of the above-mentioned.

In one embodiment of the nailing machine described above, the nailing machine also includes a housing. The first cylinder and the second cylinder disposed outside the first cylinder are disposed on the housing in a side-by-side manner. The tail end of the first cylinder is provided with a first hole. The tail end of the second cylinder is provided with a second hole. The first hole communicates with the second hole through the third hole. This design can ensure the nail gun a compact structure. The compressed air can be stored in the passage of the third hole. It is also possible for the first cylinder to be arranged inside the second cylinder according to the prior art and the teachings of the above-mentioned.

In one embodiment of the nailing machine described above, the pawl is connected to the housing through a first pivot. The housing is also provided with a second pivot. A first link is fixedly connected to the first pivot. The swing bar is fixedly connected to the second pivot. A second link is arranged between the swing bar and the first link. The two ends of the second link are respectively hinged with the first link and the swing bar. The hinge point of the second link and the swing bar is located in the middle of the swing bar so that one end of the swing bar can collide with the actuator. The actuator, rotated by the motor, and, during each revolution, can strum the swing bar once. The swing bar rotates the first link through the second link, then rotates the first pivot, so as to push the pawl, which is connected with the first pivot, realizing the trigger.

In one embodiment of the nailing machine described above, the striker is a strip-shaped plate. The locking part is a groove formed on the side wall of the striker. The pawl abuts on the groove, so that the striker cannot move forward in the first cylinder. It has a simple structure, and can be fabricated easily.

In one embodiment of the nailing machine described above, the groove wall of the groove includes a section of abutment and a section of arc. The abutment is flat and perpendicular to the length direction of the striker. The arc extends from the side wall of the striker to the abutment. During the movement of the striker, the pawl slides along the side wall of the striker, and finally abuts against the abutment. Under the action of the motor, the pawl can also disengage from the abutment. The abutment is flat and perpendicular to the length direction of the striker. This ensures the stability during snap hold, and also facilitates the disengagement of the pawl.

In one embodiment of the nailing machine described above, a torsion spring capable of making the end of the pawl abut against the side wall of the striker is connected to the pawl. The resetting force generated by the torsion spring against the pawl, ensures that the pawl abuts against the locking part to achieve the limiting action. Thus, there is a resetting piece that resets the pawl by elasticity. The resetting piece can be a torsion spring. This can also be achieved by the restoring force or the like, generated by the torsion spring provided on the first pivot and/or on the second pivot, or by the restoring force, generated by a tension spring connected to the pawl or to the swing bar according to the teachings the above-mentioned.

Compared with the prior art, the invention has the following advantages:

1. In one embodiment of the nailing machine, the motor drives the second piston to compress air, and triggers the pawl to achieve the rapid and continuous firing of strip nails. It has a compact structure, with stability and reliability.
2. In one embodiment of the nailing machine, the motor can both compress air and realize the automatic firing of the striker. It has a high degree of automation.

DETAILED DESCRIPTION OF THE INVENTION

Figure 1:
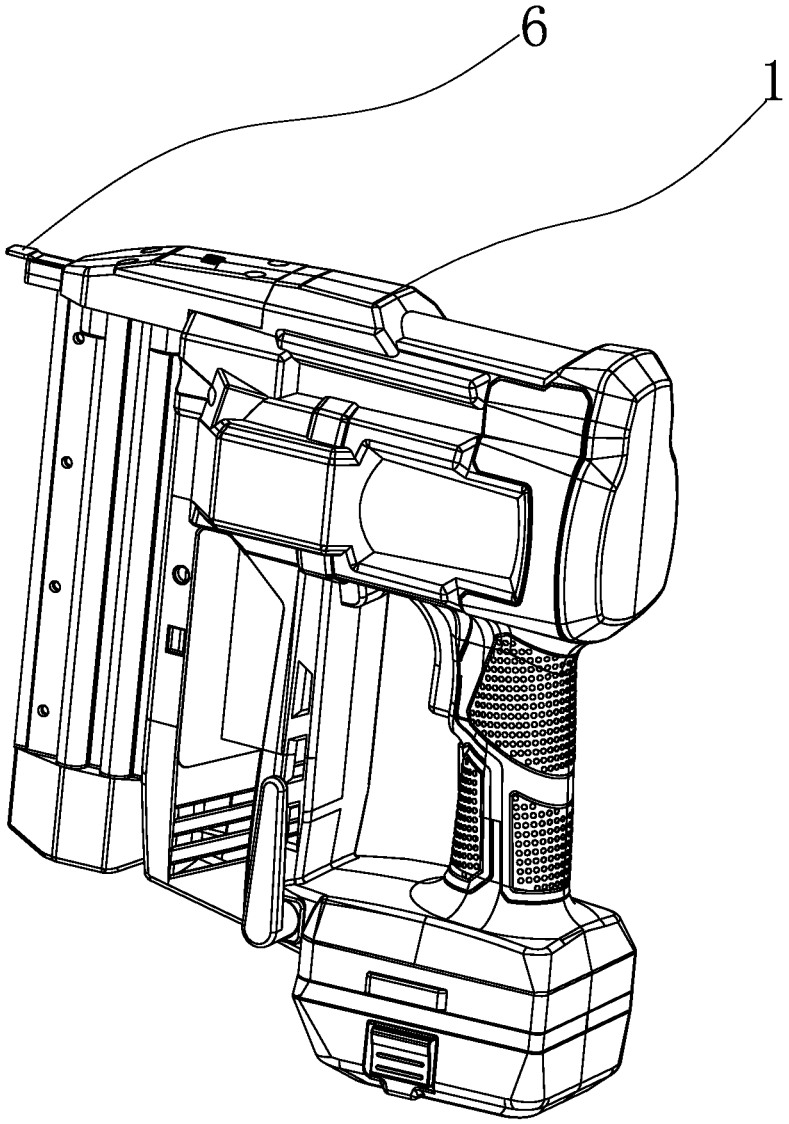
FIG. 1 is a perspective view of one embodiment of the nailing machine.

The embodiments of this invention will be described below and the technical solutions of the invention will be further illustrated in connection with the accompanying figures. However, the present invention shall not be limited to these embodiments.

As shown in FIGS. 1 to 7, one embodiment of the nailing machine includes a housing 1, the first cylinder 2, and the second cylinder 3, whose tail ends communicate with each other. The first cylinder 2 and the second cylinder 3 are arranged side by side on the housing 1. The tail end of the first cylinder 2 is provided with a first hole 11. The tail end of the second cylinder 3 is provided with a second hole 12. The first hole 11 communicates with the second hole 12 through the third hole 13. The first cylinder 2 has a first piston 4 inside. The first piston 4 is fixedly connected to the striker 6. The second cylinder 3 has a second piston 5 inside. And the second piston 5 is connected with the motor 7. The striker 6 has a locking part 8. The nailing machine also includes a pawl 9 capable of snapping at the locking part 8. The motor 7 can reciprocate the second piston 5 and also drive the pawl 9 to disengage from the locking part 8.

The motor 7 in one embodiment is a direct current motor 7. The rotating shaft of the direct current motor 7 is fixedly connected with an hinge axle 14 that is capable of rotating circumferentially about the axis of the rotating shaft through a crank 10. The hinge axle 14 is parallel to the rotation axis of the motor 7. The hinge axle 14 is also pivotally connected with the rod 15 connected with the second piston 5. One end of the rod 15 is pivotally connected to the hinge axle 14. The other end is hinged on the second piston 5. The DC motor 7 reciprocates the second piston 5 between the first position and the second position of the second cylinder 3. When the second piston 5 is in the first position, a negative pressure is formed in the second cylinder 3. The first piston 4 is subject to suction. Since the first cylinder 2 and the second cylinder 3 are communicated with each other. The first piston 4 moves inward. The striker 6 also retracts into the first cylinder 2. And then the pawl 9 snaps at the locking part 8 of the striker 6, limiting the movement of the striker 6. Then, the DC motor 7 drives the second piston 5 for the next stroke. The second piston 5 moves to the second position. Since the first piston 4 and the striker 6 are constrained by the snap hold between the pawl 9 and the locking part 8, the first piston 4 and the striker 6 remain stationary. The movement of the second piston 5 compresses the air, forming a high-pressure gas. The motor 7 drives the second piston 5 to compress the air and the compressed air is stored in the passage of the third hole 13. After the second piston 5 is in the second position, motor 7 continues to work, triggers the pawl 9, so that the pawl 9 disengages from the locking part 8. Pushed by high-pressure gas, the striker 6 ejects rapidly and forcefully along with the first piston 4.

The nailing machine is also often used in conjunction with a nail magazine capable of holding strip nails. The strip nails are placed inside the magazine. And the first nail of the strip nails can be opposite to the striker 6. Through the impact of the striker 6, the nails are nailed into the object or shot out. Since a motor 7 is used to compress the air and to trigger the pawl 9, the orderly integration achieves a rapid and continuous firing of strip nails.

Figure 2:
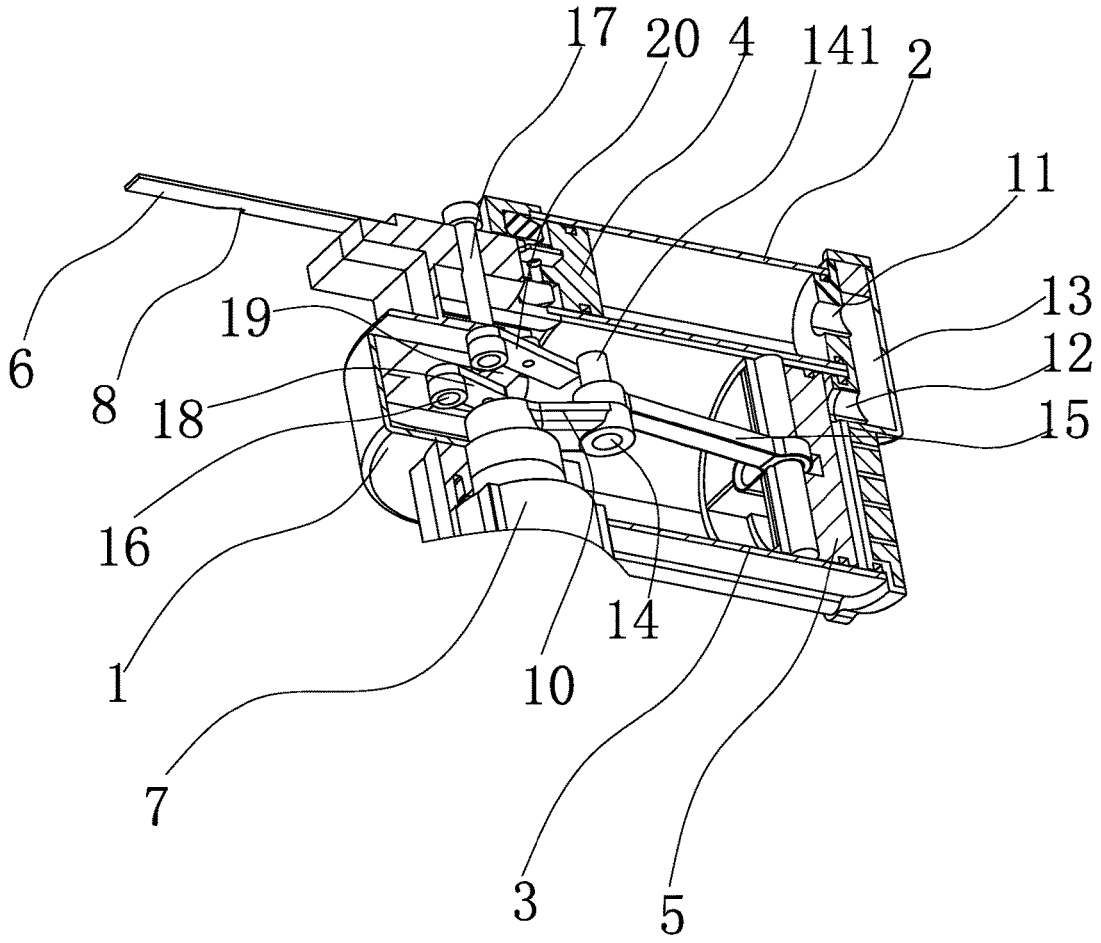
FIG. 2 is a first stereoscopic cross-sectional view of one embodiment of the nailing machine.
Figure 3:
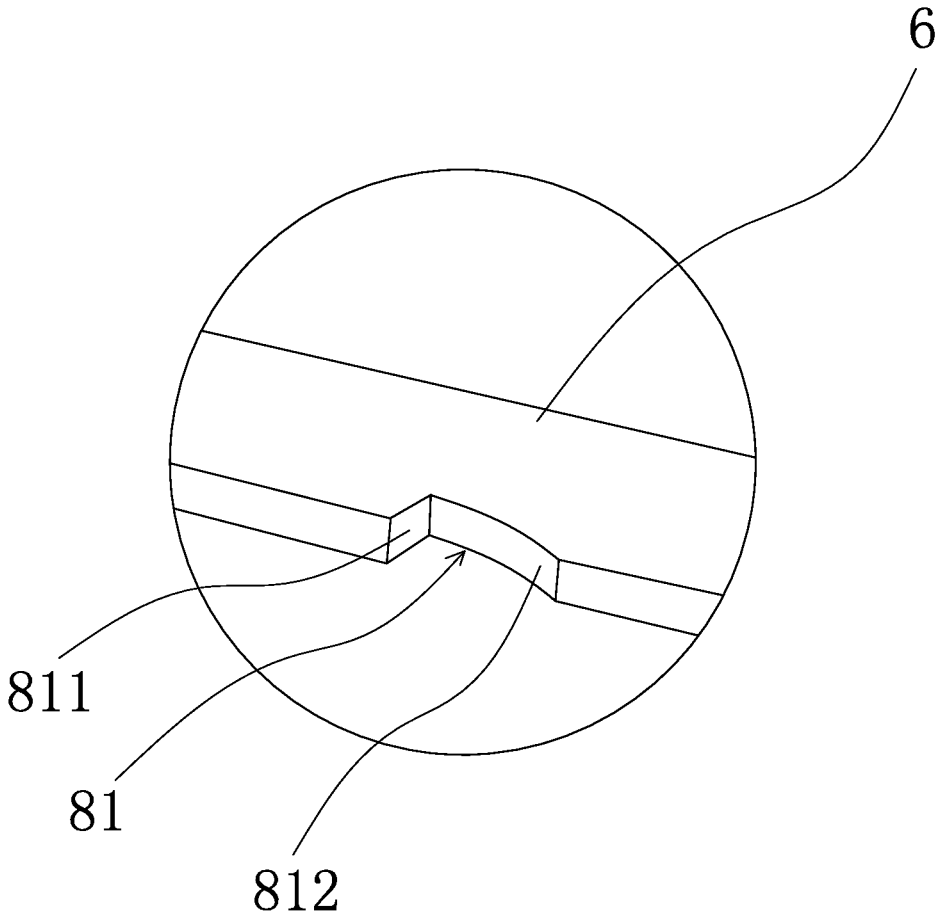
FIG. 3 is an enlarged view of locking part of one embodiment of the nailing machine.
Figure 4:
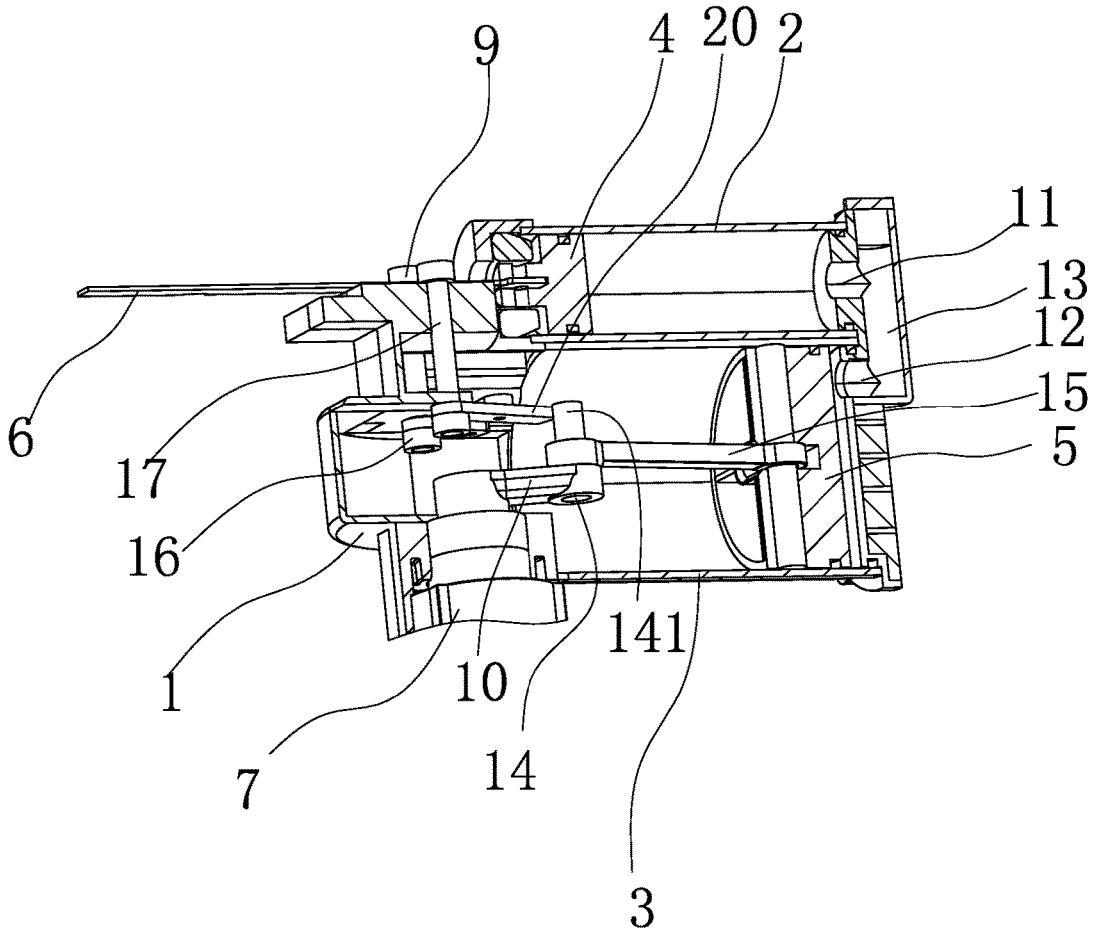
FIG. 4 is a second stereoscopic cross-sectional view of one embodiment of the nailing machine.
Figure 5:
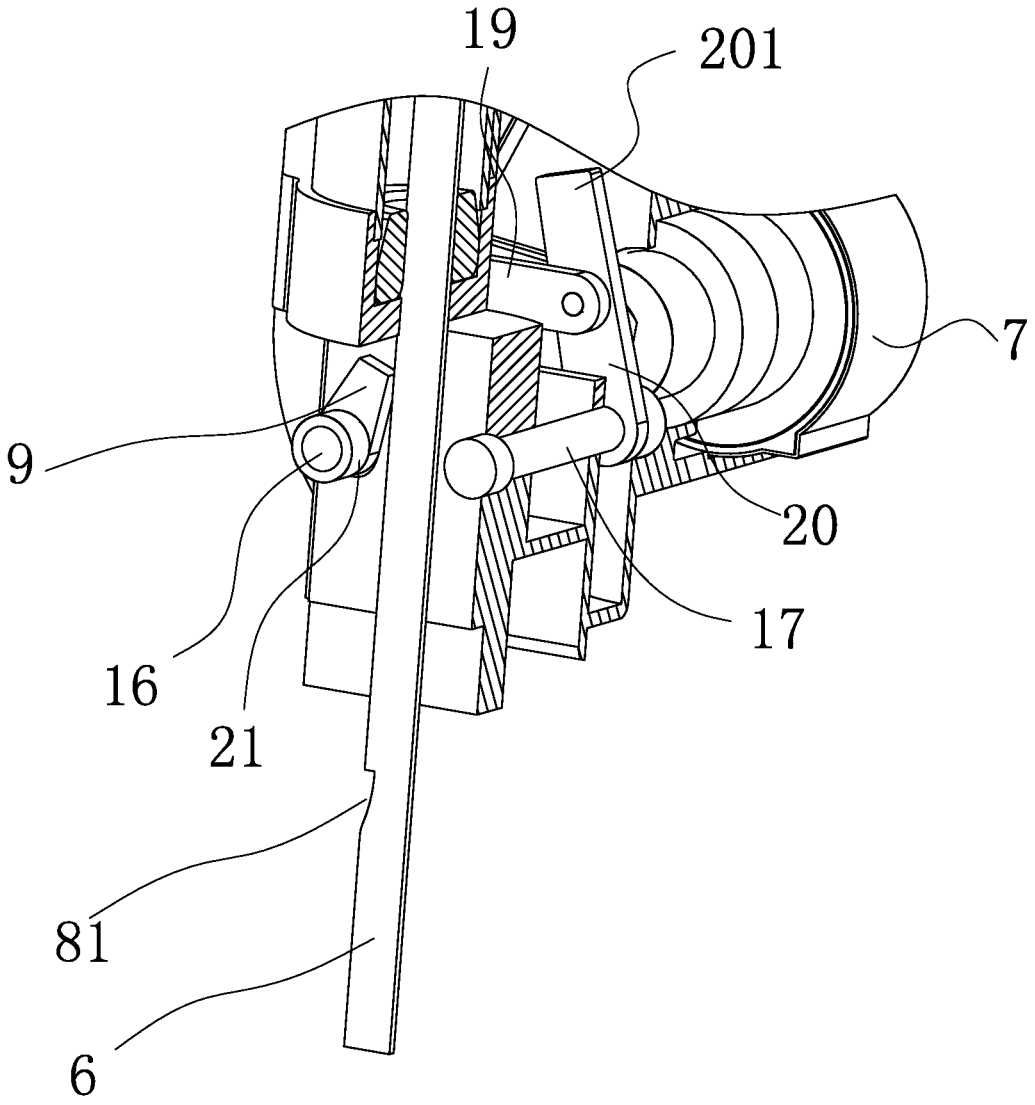
FIG. 5 is a partial structural view of one embodiment of the nailing machine with striker shooting out.
Figure 6:
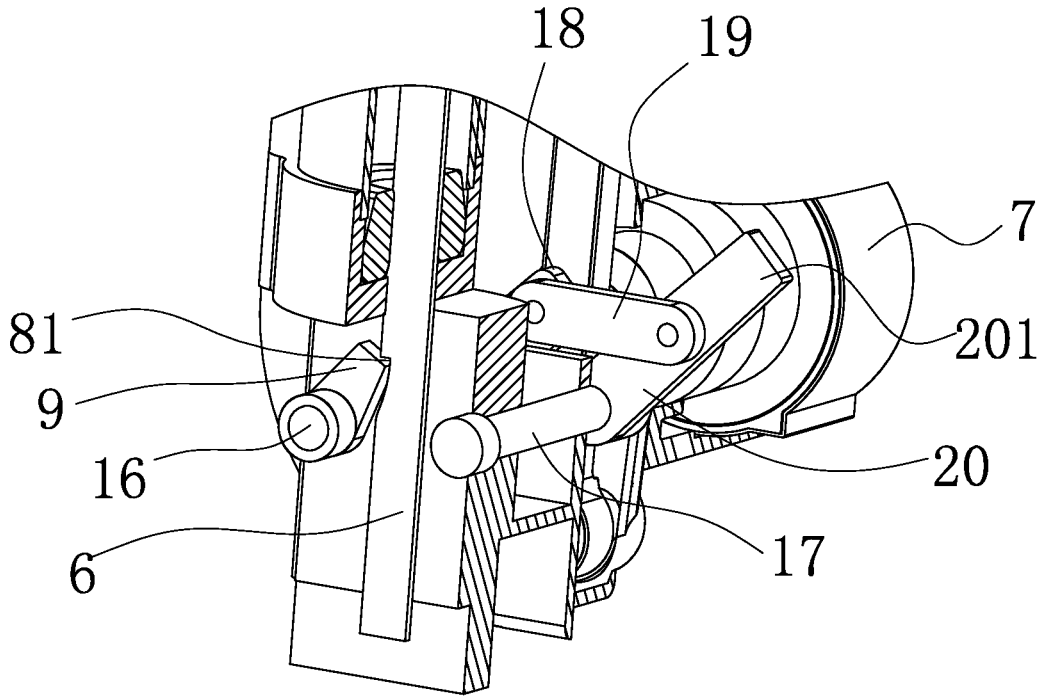
FIG. 6 is a partial structural view when the striker and pawl of one embodiment of the nailing machine snap with each other.
Figure 7:
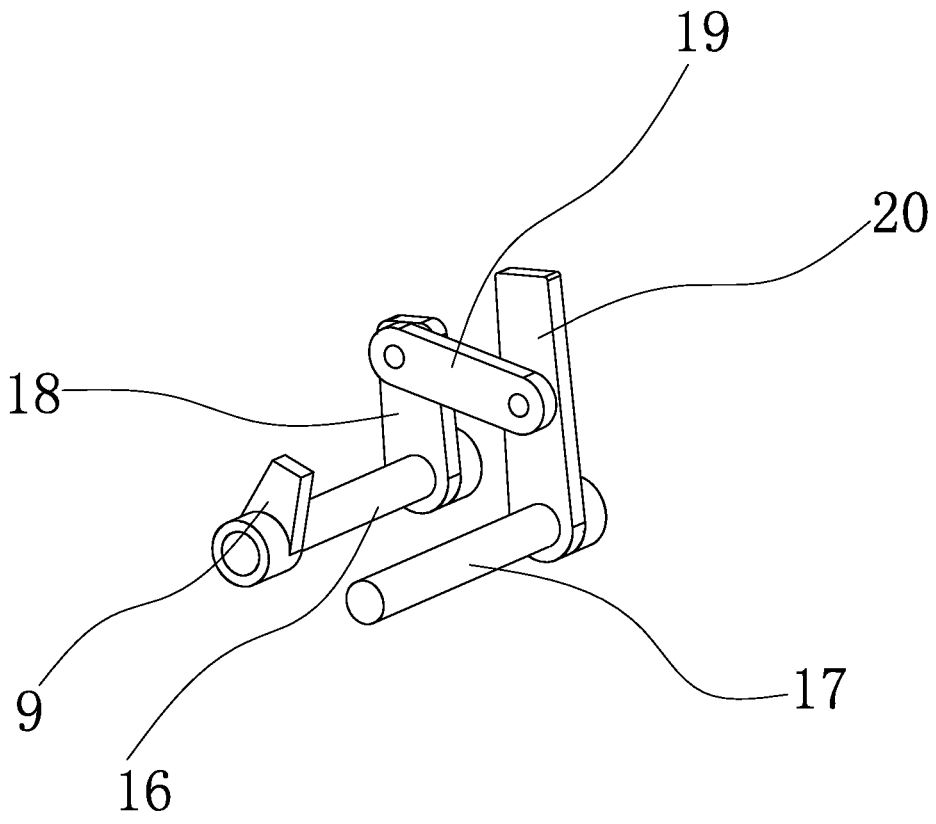
FIG. 7 is a structural view of the pawl of one embodiment of the nailing machine.

As shown in FIGS. 2 and 4, the pawl 9 is connected to the housing 1 through a first pivot 16. The housing 1 is also provided with a second pivot 17. A first link 18 is fixedly connected to the first pivot 16. The second pivot 17 is fixedly connected with the swing bar 20. A second link 19 is arranged between the swing bar 20 and the first link 18. The two ends of the second link 19 are respectively hinged with the swing bar 20 and the first link 18. The hinge axle 14 extends outwardly at one end to form the actuator 141, the swing bar 20 can abut against the actuator 141. The actuator 141 of the hinge axle 14 is rotated by the DC motor 7, which during each revolution, can trigger the swing bar 20 once. The swing bar 20 drives the first link 18 to rotate through the second link 19, and, then drives the first pivot 16 to rotate, so as to drive the pawl 9 connected to the first pivot 16 to move, realizing the trigger. It is obvious that the swing bar 20 is swingably connected to the housing 1 and the pawl 9 is linked with the swing bar 20. The cusp 201 of the swing bar 20 is also located on the moving track of the actuator 141 so that the actuator 141 only pushes the hem of the cusp 201 of the swing bar 20 and to move the pawl 9. And when the actuator 141 continues to move forward, the cusp 201 of the swing bar 20 is separated from the actuator 141.

As shown in FIGS. 2, 3, 5, and 6, the striker 6 is a strip-shaped plate. The locking part 8 is a groove 81 formed on the side wall of the striker 6. The groove wall of the groove 81 is composed of an abutment 811 and an arc 812. The abutment 811 is perpendicular to the length direction of the striker 6, arc 812 extends from the side wall of striker 6 to abutment 811. The pawl 9 can abut against the abutment 811, so that the striker 6 cannot move forward in the first cylinder 2. The pawl 9 is also connected with a torsion spring 21, capable of abutting the end of the pawl 9 against the side wall of the striker 6, which ensures that the pawl 9 abuts against the locking part 8 to achieve the limiting effect.

The description of the preferred embodiments thereof serves only as an illustration of the scope of the invention. It will be understood by those skilled in the art that various changes or supplements in form and details may be made therein without departing from the scope of the invention as defined by the appended claims.

LIST OF REFERENCE NUMERALS

1. housing
2. first cylinder
3. second cylinder
4. first piston
5. second piston
6. striker
7. motor
8. locking part
81. groove
811. abutment
812. arc
9. pawl
10. crank
11. first hole
12. second hole
13. third hole
14. hinge axle
15. rod
16. first pivot
17. second pivot
18. first link
19. second link
20. swing bar
21. torsion spring

What is claimed is:

1. A nailing machine, comprising:

a first cylinder having a first working chamber;

a first piston in the first cylinder;

a striker with a locking part is fixedly connected to the first piston;

a second cylinder having a second working chamber, the first working chamber communicates with the second working chamber;

a second piston in the second cylinder;

a motor, the second piston reciprocated by the motor between a first position and a second position of the second cylinder;

a pawl is reset by a resetting force;

a swing bar hinged to a housing, the swing bar links with the pawl to keep a synchronous motion; and an actuator, driven by the motor to make a circular motion;

wherein after the motor drives the second piston to the first position and after the first piston moves inward together with the striker, the pawl is engaged with the locking part of the striker; and wherein when the motor drives the second piston to the second position, the motor synchronously drives the second piston and the actuator, and the actuator pushes the swing bar once and causes the pawl to disengage from the locking part during each revolution of the actuator.

2. The nailing machine according to claim 1, further comprising:

a first hole at a first tail end of the first cylinder; and a second hole at a second tail end of the second cylinder, the first hole communicates with the second hole through a third hole;

wherein the first cylinder and the second cylinder disposed outside the first cylinder are disposed on the housing in a side-by-side manner.

3. The nailing machine according to claim 2, further comprising:

a hinge axle provided on a crank which is pivot connected with a rotating shaft of the motor and the hinge axle is capable of rotating circumferentially about an axis of the rotating shaft of the motor;

wherein one end of the hinge axle extends outward to form the actuator; and wherein, alternatively, the actuator is formed directly on the crank or directly formed on a rotating shaft of the motor.

4. The nailing machine according to claim 3, further comprising:

a first pivot connecting the pawl to the housing;

a second pivot in the housing, the second pivot fixedly connected with the swing bar;

a first link fixedly connected to the first pivot;

a second link arranged between the first link and the swing bar;

two ends of the second link hinged with the first link and the swing bar; and a hinge point of the second link and the swing bar located in a middle of the swing bar such that one end of the swing bar is capable of contacting with the actuator.

5. The nailing machine according to claim 1, wherein the striker is a strip-shaped plate; and wherein the locking part is a groove formed on a side wall of the striker.

6. The nailing machine according to claim 5, further comprising:

a groove wall of the groove, the groove wall having a section of abutment and a section of arc;

wherein the abutment is flat and perpendicular to a length direction of the striker; and wherein the arc extends from a side wall of the striker to the abutment.

7. The nailing machine according to claim 6, further comprising:

a torsion spring connected to the pawl, the torsion spring capable of making an end of the pawl abut against a side wall of the striker.

8. The nailing machine according to claim 1, further comprising:

a resetting piece that resets the pawl by elasticity.

* * * * *